United States Patent [19]

Tokunaga et al.

[11] Patent Number: 4,837,109

[45] Date of Patent: Jun. 6, 1989

[54] METHOD OF PRODUCING NEODYMIUM-IRON-BORON PERMANENT MAGNET

[75] Inventors: Masaaki Tokunaga, Fukaya; Kimio Uchida; Akitoshi Hiraki, both of Kumagaya, all of Japan

[73] Assignee: Hitachi Metals, Ltd., Tokyo, Japan

[21] Appl. No.: 71,937

[22] Filed: Jul. 10, 1987

[30] Foreign Application Priority Data

Jul. 21, 1986 [JP] Japan ..... 61-171304
Oct. 29, 1986 [JP] Japan ..... 61-257285

[51] Int. Cl.[4] ..... C22C 38/00

[52] U.S. Cl. ..... 420/83; 420/121; 420/581; 148/302

[58] Field of Search ..... 420/83, 121, 581; 148/302; 75/84.4, 43, 92, 94

[56] References Cited

U.S. PATENT DOCUMENTS 4,597,938 7/1986 Matsuura et al. ..... 419/23

FOREIGN PATENT DOCUMENTS 0126179 11/1984 European Pat. Off. ..... 148/302
0184722 6/1986 European Pat. Off. ..... 420/83
59-177346 10/1984 Japan .
59-215460 12/1984 Japan .
59-219404 12/1984 Japan .
61-84340 4/1986 Japan .

*Primary Examiner*—Deborah Yee
*Attorney, Agent, or Firm*—Finnegan, Henderson, Farabow, Garrett & Dunner

[57] ABSTRACT

A method of producing a neodymium-iron-boron permanent magnet alloy having a composition of 25.0–50.0 weight % of neodymium, 0.3–5.0 weight % of boron and balance substantially iron, including the steps of adding metal calcium, calcium hydride or a mixture thereof as a reducing agent to neodymium fluoride, iron and boron (or ferroboron), and further adding thereto at least one of calcium chloride, sodium chloride and potassium chloride as a flux, melting the resulting mixture in an inert gas atmosphere, or in a reducing gas atmosphere or substantially in vacuum at 1,000°–1,300° C., thereby reducing said neodymium fluoride to provide said alloy with as small a calcium content as 0.1 weight % or less. The starting materials may contain dysprosium fluoride and niobium to provide Nd-Dy-Fe-B-Nb alloys containing 0.5–15.0 weight % Dy and 0.05–5.0 weight % Nb. This method makes it possible to produce Nd-Fe-B or Nd-Dy-Fe-B-Nb permanent magnet alloys with as small a calcium content as 0.1 weight % or less directly from starting materials. Accordingly, it is economically advantageous over the conventional reduction method which produces mother alloys.

12 Claims, 2 Drawing Sheets

METHOD OF PRODUCING NEODYMIUM-IRON-BORON PERMANENT MAGNET

BACKGROUND OF THE INVENTION

The present invention relates to a method of inexpensively producing a neodymium-iron-boron permanent magnet alloy.

It is known to produce a rare earth-iron-boron permanent magnet, a new high-performance permanent magnet, by a method comprising using as starting materials rare earth metals, electrolytic iron, electrolytic cobalt, pure boron or ferroboron, and melting, pulverizing, pressing in a magnetic field and sintering (Japanese Pat. Laid-Open No. 59-215460). This conventional melting method, however, is costly because it uses expensive rare earth metals.

Recently a so-called reduction method has been proposed as an alternative to the melting method. For instance, Japanese Pat. Laid-Open No. 59-219404 discloses a method of producing a rare earth-iron-boron permanent magnet alloy powder by a reduction reaction which comprises the steps of mixing rare earth oxide powder, iron powder, ferroboron powder and cobalt powder with metal calcium or calcium hydride in an amount of 2–4 times (by weight) as much as stoichiometrically necessary for the reduction of the rare earth oxide powder, heating them in an inert gas atmosphere at 900°–1200° C., and washing the resulting reaction product in water to remove reaction by-products.

And Japanese Pat. Laid-Open No. 59-177346 discloses the use of a flux in the reduction method to lower the viscosity of a eutectic melt.

The above conventional reduction method (Japanese Pat. Laid-Open No. 59-219404) needs water washing for a long period of time to remove calcium oxide, a by-product of the reduction reaction. For the rare earth element-iron-boron alloys rich in iron, extreme oxidation takes place in this water washing step, increasing the oxygen content in the resulting alloys. Thus, it is difficult to stably obtain magnet alloys with good magnetic properties.

At the same time it is extremely difficult to completely remove calcium oxide by water washing, and the remaining calcium oxide lowers the sinterability of the permanent magnet alloys in the sintering step, thereby deteriorating the magnetic properties of the resulting permanent magnets.

And the conventional reduction method using a flux (Japanese Pat. Laid-Open No. 59-177346) did not succeed in reducing the calcium content in the resulting alloys to an acceptable level.

Recently, a proposal was made to produce a neodymium-iron or neodymium-iron-boron mother alloy for use in producing neodymium-iron-boron magnet alloys by charging starting materials of neodymium fluoride, calcium, iron and if necessary, boron oxide together with calcium chloride as a flux to an iron container, and melting them at 750°–1000° C. in a non-oxidizing atmosphere to reduce the neodymium fluoride to neodymium (Japanese Pat. Laid-Open No. 61-84340). This method, however, fails to provide a neodymium-iron-boron alloy containing an extremely small amounts of calcium. Accordingly, the magnets produced from these mother alloys inevitably contain relatively large amounts of calcium which acts to decrease magnetic properties. In addition, since the mother alloys have compositions far different from those of the final permanent magnets, an additional melting step is needed to change the compositions of the alloys to the desired ones by the addition of iron and boron.

OBJECT AND SUMMARY OF THE INVENTION

An object of the present invention is, therefore, to solve these problems of the conventional techniques, thereby providing neodymium-iron-boron permanent magnet alloys with extremely little calcium and oxygen and thus excellent magnetic properties.

As a result of intense research in view of the above object, the inventors have found that since calcium has a strong affinity for neodymium, the mother alloys of the above prior art inevitably contain a large amount of calcium, and that the control of neodymium content to as low as 25–50 weight % not only can reduce the calcium content in the resulting alloys, but also can provide alloys which may be directly formed into Nd-Fe-B magnets. The present invention is based on this finding.

That is, the method of producing a neodymium-iron-boron permanent magnet alloy according to the present invention comprises adding metal calcium, calcium hydride or a mixture thereof as a reducing agent to a mixture of neodymium fluoride, iron and boron (or ferroboron), and further adding thereto at least one of calcium chloride, sodium chloride or potassium chloride as a flux, and melting the resulting mixture in an inert gas atmosphere, or in a reducing gas atmosphere or substantially in vacuum at 1000°–1300° C., thereby reducing the neodymium fluoride to provide the alloy consisting essentially of 25.0–50.0 weight % of neodymium, 0.3–5.0 weight % of boron and balance substantially iron with extremely little calcium. The starting materials may contain dysprosium fluoride so that the resulting alloy contains 0.5–15 weight % of Dy.

DETAILED DESCRIPTION OF THE INVENTION

Figure 1:
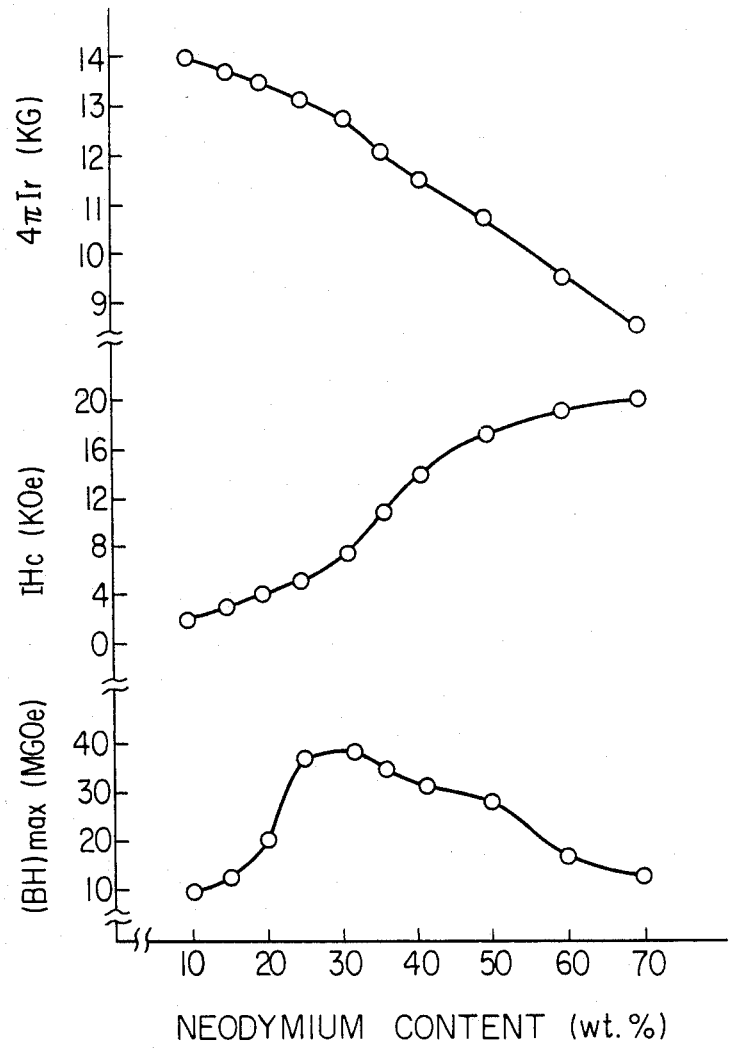
FIG. 1 is a graph showing the relation between the amount of neodymium and magnetic properties for the neodymium-iron-boron permanent magnet prepared according to one embodiment of the present invention.

As a starting material for a rare earth component, neodymium fluoride is used and it is mixed with iron and boron (or ferroboron) in such amounts that the composition after the reduction reaction may be 25.0–50.0 weight % of neodymium, 0.3–5.0 weight % of boron, and balance substantially iron. And when alloys consisting essentially of 25.0–50.0 weight % of Nd, 0.5–15 weight % of Dy, 0.3–5.0 weight % of B, 0.05–5.0 weight % of Nb and balance Fe are to be prepared, the starting materials should further contain dysprosium fluoride and niobium or ferroniobium.

The neodymium fluoride starts to be reduced by the reducing agent from about 800° C. in the process of heating, and is completely reduced at 1000°–1300° C. The amount of the reducing agent should be 1.0 or more times (by weight) the stoichiometric amount necessary for completing the reduction. However, the use of an excess amount of the reducing agent is not preferable because it enhances the production cost of the alloy and also increases the amount of calcium contained in the resulting alloy. Accordingly, the upper limit of a practical amount of the reducing agent is 4.0 times (by weight). The amount of the reducing agent is preferably 1.25–2.0 times (by weight). Incidentally, when the starting materials contain dysprosium fluoride, it is reduced like neodymium fluoride.

The reduced neodymium and dysprosium, if any, are alloyed with iron, boron (or ferroboron) and niobium (or ferroniobium), if any. Calcium fluoride generated as a by-product in this process forms a slag. Since calcium fluoride has as high a melting point as about 1360° C., it is difficult to separate the slag from the alloy at temperatures of 1000°–1300° C.

The first important point of this invention is the addition of at least one of calcium chloride, sodium chloride and potassium chloride as a flux to facilitate he separation of the slag from the alloy by lowering the melting point of the slag. Calcium chloride has a melting point of about 770° C., sodium chloride about 800° C. and potassium chloride about 780° C., and the addition of these flux compounds makes it easier to separate the slag from the alloy of the above composition at temperatures of 1000° C. or slightly higher. The amount of the flux added is 0.05–4.0 times (by mole) the stoichiometric amount of calcium fluoride formed by the reduction reaction. When the amount of the flux is less than 0.05 times (by mole), the melting point of the slag is not lowered, making the separation of the slag from the alloy insufficient. On the other hand, when it is more than 4.0 times (by mole), the percentage of the flux to the starting materials (particularly ratio by volume) is too high, so that the production of the alloy becomes less efficient. In addition, the use of an excess amount of the flux undesirably increases the production cost of the alloy, and the amount of calcium transferred from the slag into the alloy. The preferred amount of the flux is 0.5–3.0 times by mole.

As a flux, any one of calcium chloride, sodium chloride and potassium chloride has the above separation effects. But the addition of two or more of the above flux compounds provides separation effects equal to or better than the addition of a single flux component.

The second important point of the present invention is to use neodymium fluoride and if necessary dysprosium fluoride, iron and boron (or ferroboron), and further if necessary, niobium (or ferroniobium), in such amounts that the composition after the reduction of the neodymium fluoride and the dysprosium fluoride, if any, may be 25.0–50.0 weight % of neodymium. 0.5–15.0 weight % of dysprosium, if any, 0.3–5.0 weight % of boron, 0.05–5.0 weight % of niobium, if any, and balance iron. That is, the amount of neodymium is far less than that necessary for forming a eutectoid with iron. Accordingly, the melting of 25.0–50.0 weight % Nd plus Fe requires much higher temperature than its eutectoid. It is our outstanding discovery that although higher heating temperatures are generally disadvantageous, the direct production of Nd-Fe-B alloys having the above composition by reduction using a calcium reducing agent is advantageous because it can provide the resulting alloys with extremely small calcium content, which is generally 0.1 weight % or less. The calcium content in the resulting alloy is preferably 0.06 weight % or less.

Figure 2:
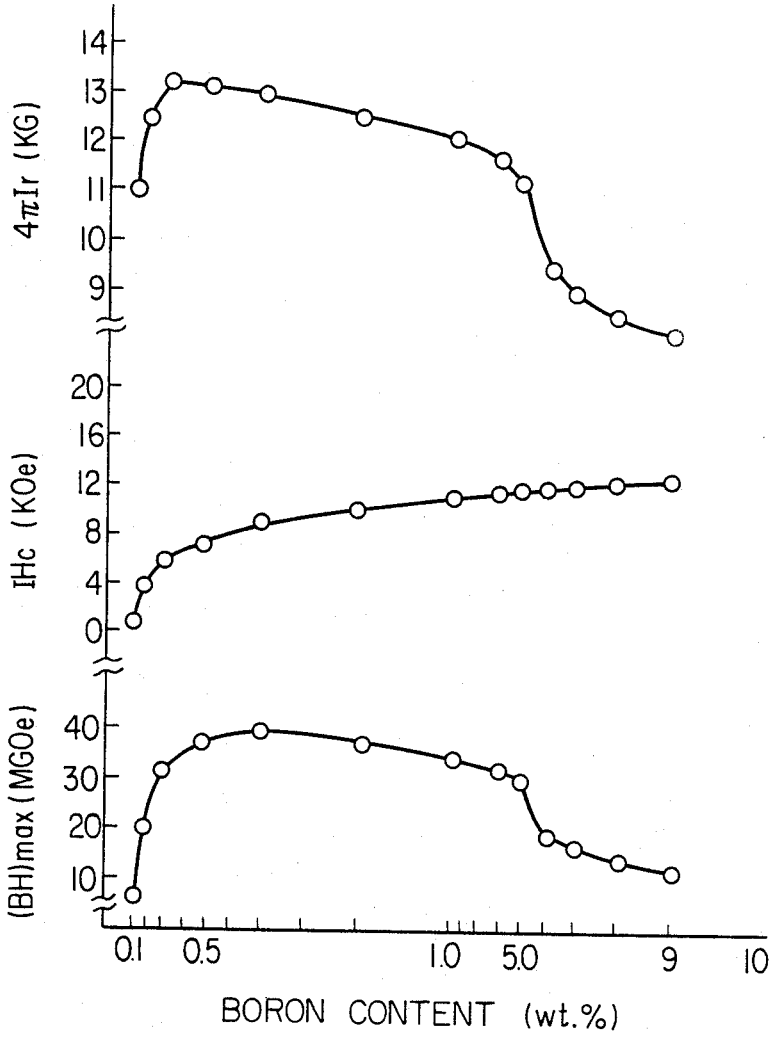
FIG. 2 is a graph showing the relation between the amount of boron and magnetic properties for the neodymium-iron-boron permanent magnet prepared according to another embodiment of the present invention.

The above composition range can provide permanent magnets with excellent magnetic properties. Specifically, neodymium should be 25.0–50.0 weight %. When it is less than 25.0 weight %, sufficient coercive force cannot be provided, and when it exceeds 50.0 weight %, the residual magnetic flux density is low. The preferred amount of neodymium is 30–40 weight %. This is exemplified by FIG. 1 which shows the magnetic properties of Nd-Fe-B alloys containing 1.3 weight % B and balance Fe. Part of neodymium may be substituted by dysprosium. The dysprosium content would be 0.5–15.0 weight %, if added. When it is less than 0.5 weight %, sufficient improvement of coercive force cannot be obtained, and when it exceeds 15.0 weight %, the residual magnetic flux density of the alloy is reduced. Boron is 0.3–5.0 weight %. When it is less than 0.3 weight %, sufficient residual magnetic flux density and coercive force cannot be obtained, also providing low Curie temperature Tc. And when it is higher than 5.0 weight %, the residual magnetic flux density is low. The preferred amount of boron is 0.6–2.0 weight %. This is exemplified by FIG. 2 which shows the magnetic properties of Nd-Fe-B alloys containing 36.0 weight % Nd and balance Fe. Further, niobium may be added in an amount of 0.05–5.0 weight %. When it is less than 0.05 weight %, substantially no increase in coercive force is appreciated, and when it exceeds 5.0 weight %, the residual magnetic flux density of the alloy is reduced and undesirable phases are generated.

Thus, the present invention is characterized by providing the alloy having the composition exactly corresponding to that of the desired permanent magnet. What is first necessary for the effective separation of the slag from the alloy is to lower the melting point of the slag to make it easier to keep it in a molten state. For this purpose, the addition of the above flux is effective. At the same time, it is necessary that the resulting neodymium-iron-boron alloy is in a molten state. Only when both of these conditions are is satisfied is the alloy well separated from the slag.

According to our research, the alloy of the above composition is not melted at temperatures lower than 1000° C., so that the alloy is not separated from the slag. Therefore, this alloy is melted at temperatures of 1000° C. or higher, enabling it to be separated from the slag. Accordingly, the heating temperature should be 1000° C. or higher. To perform the separation with more certainty, the heating temperature is preferably 1050° C. or higher. On the other hand, if the heating temperature is too high, larger amounts of impurities are transferred into the resulting alloy melt from a crucible containing the starting materials. And also too much energy is consumed. Thus, it is not preferable from the economic point of view, too. Accordingly, the heating temperature has its own upper limit, which is 1300° C. Thus, the heating temperature is 1000°–1300° C., preferably 1050°–1300° C. It would be sufficient to conduct the heating for 10 minutes or more, and the separation is made certain by the heating for 30 minutes or more.

Any slag formed under the conditions of the present invention has a melting point lower than 1000° C. Accordingly, by heating at 1000–1300° C. the slag is melted so that the alloy having a larger specific gravity sinks on the bottom of the container while the slag having a smaller specific gravity floats on the alloy.

Incidentally, it is not impossible to separate the slag from the alloy at a heating temperature lower than 1000° C. by a reduction method. As is well known, a neodymium-iron binary alloy has a eutectic temperature of about 640° C. Thus, the ratio of neodymium fluoride to iron or ferroboron may be selected so that the resulting alloy melt has a neodymium-iron binary eutectic composition of 75 weight % neodymium and 25 weight % iron. By selecting the amount of neodymium much larger than in the present invention, the resulting alloy can be separated from the slag at heating temperatures lower than 1000° C., specifically 700°-900° C. In this case, however, there are two large problems. One of them is that since an excess amount of neodymium is contained in the alloy composition, the separated alloy inevitably contains a large amount of calcium dissolved in the alloy which comes from the reducing agent. The other problem is that since the resulting alloy has a composition which largely deviates from the desired composition for a permanent magnet, the adjustment of composition by remelting is necessary for providing an alloy for a permanent magnet. This largely affects the magnetic properties of the resulting permanent magnets and their production costs.

On the contrary, the method of producing an alloy according to the present invention is characterized in that the production cost is low because it provides an alloy of the composition which is exactly the same as that of the desired permanent magnet, and that the preparation of such alloy makes it possible to minimize calcium content in the alloy. Permanent magnets can be produced from this alloy by a powder metallurgy method comprising pulverization of the alloy, pressing alloy powders by a die, sintering and heat treatment. And since the alloy prepared by the present invention contains a smaller amount of neodymium than a neodymium-iron alloy of the eutectic composition, the former alloy contains an extremely small amount of calcium remaining therein in the form of a solid solution, exerting substantially no adverse effects on the magnetic properties. For the same reasons, the amount of oxygen in the alloy is also smaller than in the eutectic composition. Because of the above-mentioned features of the present invention, the method of the present invention can produce a neodymium-boron-iron permanent magnet alloy with excellent magnetic properties at low cost.

Next, starting materials used for the production of the permanent magnet alloy according to the present invention will be explained below. Commercially available neodymium fluoride may be a under 100 mesh in particle size may be used. Its purity (Nd content in the total rare earth elements) is desirably 95 weight % or more. Commercially available dysprosium fluoride may also be under 100 mesh also may be used. Iron may be used in essentially bulk form. However, to carry out alloying with the reduced neodymium element smoothly, it is advantageously in a powder form, and it is desirably under 32 mesh or so. Its purity may be on the same level as commercially available pure iron. As for boron, it may be commercially available pure boron under 10 mesh or so. It may also be a pulverized. And in some cases, commercially available boron oxide may be used. In this case, an additional reducing agent should be added in an amount necessary for reducing the boron oxide added. In this case, a small amount of calcium oxide is formed by the reduction reaction of boron oxide. Since calcium oxide acts to elevate the melting point of the slag, it is not desirable. However, since the boron content of the alloy prepared by the method of the present invention is as small as 0.3-5.0 weight %, the ratio of calcium oxide formed by using boron oxide to the slag is extremely small, exerting substantially no adverse effects on the separation of the alloy from the slag under the conditions of the production method of the present invention. Further, from the economic point of view, it is more advantageous to use a commercially available ferroboron than to use pure boron or boron oxide. It may be in bulk form. However, for the same reasons as for iron, it is desirably in the form of powder under 32 mesh or so.

Niobium is preferably in the form of a niobium-iron alloy, or ferroniobium. It may be in any shape, bulk or granular. However, for the same reasons as for iron, it is preferably in the form of granules under 32 mesh.

As a reducing agent, commercially available metal calcium or calcium hydride may be used. It may be in any form, powder or granules under 20 mesh or so. Its purity is desirably 99% or more.

As a flux, commercially available calcium chloride, sodium chloride or potassium chloride may be used alone or in combination. It is preferably strongly heated to completely remove water therefrom before use.

Next, a container used in the method of producing the permanent magnet alloy of the present invention will be explained. The container in which the starting materials are charged and reacted may be made of iron or stainless steel. To suppress the reaction between the molten alloy and the container material as much as possible, it is effective to coat the inner wall of the container with boron nitride, etc. Further, it may be made of tungsten or tantalum because they have excellent resistance to reaction with the molten alloy containing neodymium. In addition, containers made of ceramics such as boron nitride and aluminum nitride are suitable for the method of the present invention because they are less reactive to the molten alloy.

The starting materials for the method of the present invention are provided to have aimed compositions, mixed, for instance, in a V -type mixer, and the resulting mixture is charged into the above-mentioned container and heated for the separation of the resulting alloy from the slag. The alloy is recovered by inclining the container to pore the alloy into an ingot case. The collection of the alloy may also be carried out by providing the container with an aperture at the bottom and opening the aperture. In cases where a ceramic container less reactive to the molten alloy is used, it may be cooled down to room temperature while retaining the separated alloy and slag in the container to remove the slag later.

When an iron container is used, reaction may take place between the container and the resulting alloy. In such a case, the container is heated after completion of the reduction reaction at such temperatures that only the flux is melted, and the molten flux is removed from the container. The container is then immersed in or washed by water, alcohol or an alcohol aqueous solution to completely wash away the remaining flux. After drying in a thermostatically controlled oven in vacuum, hydrogen ga is introduced therein to let the alloy absorb the gas. As a result, the bulky alloy is turned into coarse granules. The hydrogen gas is then purged by Ar gas, and the granules are heated at 600° C. or less to remove hydrogen. Thus, the alloy prepared by the reduction reaction of neodymium fluoride and dysprosium fluoride, if any, is obtained.

The present invention will be explained in further detail by the following examples.

EXAMPLE 1

169.4 g of neodymium fluoride powder, 63.3 g of metal calcium under 10 mesh (1.25 times by weight the stoichiometrically necessary amount), 193.9 g of iron powder under 32 mesh, 22.1 g of ferroboron powder under 32 mesh (20.4 weight % boron and balance iron), 140.0 g of calcium chloride powder (1.0 times by mole the stoichiometric amount of calcium fluoride to be formed) were provided, and these starting materials were mixed in a V-type mixer to prepare 588.7 g of a mother material. This mother material was charged into a stainless steel container, and heated in an argon gas atmosphere at 1200° C. for one hour. After separation of the resulting alloy from the slag, the container is inclined to permit the alloy to flow into an ingot case. Thus, 327.5 g of the alloy was obtained. The analysis of the alloy composition revealed that it contained 35.8 weight % of neodymium, 1.29 weight % of boron, 0.02 weight % of calcium and balance iron. The oxygen content was 50 ppm.

This alloy was subjected to pulverization and further milling by a jet mill to provide fine powder of 3.0 $\mu$m in average particle size. Next, this powder was pressed under 2 tons/cm$^2$ in a magnetic field of 10 kOe, and the resulting green body was sintered in an argon gas atmosphere at 1080° C. for one hour. Finally, the sintered body was heat-treated at 600° C. for one hour. The measurement of the resulting sample with respect to magnetic properties revealed that it had a residual magnetic flux density $4\pi Ir = 12.1KG$, a coercive force $iHc = 11.0KOe$, and a maximum energy product $(BH)max = 34.5MGOe$. The sample contained 4500 ppm of oxygen and 0.02 weight % of calcium.

EXAMPLE 2

182.0 g of neodymium fluoride powder, 108.8 g of metal calcium under 10 mesh (2.0 times by weight the stoichiometrically necessary amount), 166.5 g of iron powder under 32 mesh, 19.4 g of ferroboron powder (20.4 weight % of boron and balance iron) under 32 mesh, and 150.4 g of calcium chloride powder (1.0 times by mole the stoichiometric amount of calcium fluoride to be formed) were provided, and these starting materials were mixed in a V-type mixer to prepare 627.lg of a mother material. This mother material was charged into a stainless steel container, and heated in a hydrogen gas atmosphere at 1050° C. for 2 hours After separation of the resulting alloy from the slag, the container was inclined to permit the alloy to flow into an ingot case. Thus, 309.4 g of the alloy was obtained. The analysis of the alloy composition revealed that it contained 40.8 weight % of neodymium, 1.20 weight % of boron, 0.03 weight % of calcium and balance iron. The oxygen content was 60 ppm.

This alloy was formed into a permanent magnet in the same manner as in Example 1, and its magnetic properties were measured. As a result, its residual magnetic flux density $4\pi Ir$ was 11.5KG, coercive force iHc 14.0 KOe, and maximum energy product (BH)max 31.0 MGOe. The sample had an oxygen content of 4800 ppm and a calcium content of 0.03 weight %.

EXAMPLE 3

139.5 g of neodymium fluoride powder, 65.6 g of calcium hydride powder (1.5 times by weight the stoichiometrically necessary amount), 209.1 lg of iron powder under 32 mesh, 4.5 g of pure boron powder under 10 mesh, and 151.8 g of sodium chloride powder (2.5 times by mole the stoichiometric amount of calcium fluoride to be formed) were provided, and these starting materials were mixed in a V-type mixer to prepare 570.5 g of a mother material. This mother material was charged into a boron nitride container, and heated in an argon gas atmosphere at 1300° C. for 1 hour. After separation of the resulting alloy from the slag, the container was inclined to permit the alloy to flow into an ingot case. Thus, 307.3 g of the alloy was obtained. The analysis of the alloy composition revealed that it contained 31.5 weight % of neodymium, 1.39 weight % of boron, 0.01 weight % of calcium and balance iron. The oxygen content was 45 ppm.

This alloy was formed into a permanent magnet in the same manner as in Example 1, and its magnetic properties were measured. As a result, its residual magnetic flux density $4\pi Ir$ was 12.8KG, coercive force iHc 7.5 KOe, and maximum energy product (BH)max 38.4 MGOe. The sample had an oxygen content of 4000 ppm and a calcium content of 0.01 weight %.

EXAMPLE 4

167.4 g of neodymium fluoride powder, 52.5 g of calcium hydride powder (1.0 times by weight the stoichiometrically necessary amount), 229.0 g of iron powder under 32 mesh, 4.9 g of pure boron powder under 10 mesh, and 325.6 g of potassium chloride powder (3.5 times by mole the stoichiometric amount of calcium fluoride to be formed) were provided, and these starting materials were mixed in a V-type mixer to prepare 779.4 g of a mother material. This mother material was charged into a tantalum container, and heated substantially in vacuum at 1000° C. for 4 hours. After separation of the resulting alloy from the slag, the container was inclined to permit the alloy to flow into an ingot case. Thus, 345.0 g of the alloy was obtained. The analysis of the alloy composition revealed that it contained 33.6 weight % of neodymium, 1.37 weight % of boron, 0.02 weight % of calcium and balance iron. The oxygen content was 50 ppm.

This alloy was formed into a permanent magnet in the same manner as in Example 1, and its magnetic properties were measured. As a result, its residual magnetic flux density $4\pi Ir$ was 12.5KG, coercive force iHc 9.2 KOe, and maximum energy product (BH)max 36.7 MGOe. The sample had an oxygen content of 4300 ppm and a calcium content of 0.02 weight %.

EXAMPLE 5

127.lg of neodymium fluoride powder, 66.5 g of metal calcium under 10 mesh (1.75 times by weight the stoichiometrically necessary amount), 145.4 g of iron powder under 32 mesh, 16.6 g of ferroboron powder under 32 mesh (20.4 weight % of boron and balance iron), 157.5 g of potassium chloride powder (1.5 times by mole the stoichiometric amount of calcium fluoride to be formed) and 83.0 g of sodium chloride (1.5 times by mole the stoichiometric amount of calcium fluoride to be formed) were provided, and these starting materials were mixed in a V-type mixer to prepare 596.1 lg of a mother material. This mother material was charged into a stainless steel container, and heated in an argon gas atmosphere at 1150° C. for 2 hours. After separation of the resulting alloy from the slag, the container was inclined to permit the alloy to flow into an ingot case. Thus, 245.5 g of the alloy was obtained. The analysis of the alloy composition revealed that it contained 35.7 weight % of neodymium, 1.29 weight % of boron, 0.02 weight % of calcium and balance iron. The oxygen content was 55 ppm.

This alloy was formed into a permanent magnet in the same manner as in Example 1, and its magnetic properties were measured. As a result, its residual magnetic flux density $4\pi Ir$ was 12.2KG, coercive force iHc 10.5 KOe, and maximum energy product (BH)max 35.0 MGOe. The sample had an oxygen content of 4500 ppm and a calcium content of 0.02 weight %.

EXAMPLE 6

111.6 g of neodymium fluoride powder, 26.2 g of calcium hydride powder (0.75 times by weight the stoichiometrically necessary amount), 25.0 g of metal calcium powder under 10 mesh (0.75 times by weight the stoichiometrically necessary amount), 124.6 g of iron powder under 32 mesh, 2.7 g of pure boron powder under 10 mesh and 97.2 g of sodium chloride powder (2.0 times by mole the stoichiometric amount of calcium fluoride to be formed) were provided, and these starting materials were mixed in a V-type mixer to prepare 387.3 g of a mother material. This mother material was charged into a boron nitride container, and heated in an argon gas atmosphere at 1100° C. for 4 hours. After separation of the resulting alloy from the slag, the container was inclined to permit the alloy to flow into an ingot case. Thus, 202.5 g of the alloy was obtained. The analysis of the alloy composition revealed that it contained 38.4 weight % of neodymium, 1.28 weight % of boron, 0.03 weight % of calcium and balance iron. The oxygen content was 58 ppm.

This alloy was formed into a permanent magnet in the same manner as in Example 1, and its magnetic properties were measured. As a result, its residual magnetic flux density $4\pi Ir$ was 11.8KG, coercive force iHc 12.5 KOe, and maximum energy product (BH)max 32.8 MGOe. The sample had an oxygen content of 4700 ppm and a calcium content of 0.03 weight %.

EXAMPLE 7

83.7 g of neodymium fluoride powder, 31.3 g of metal calcium powder under 10 mesh (1.25 times by weight the stoichiometrically necessary amount), 95.8 g of iron powder under 32 mesh, 11.0 g of ferroboron powder under 32 mesh (20.4 weight % of boron and balance iron), 55.3 g of calcium chloride powder (0.8 times by mole the stoichiometric amount of calcium fluoride to be formed), 29.2 g of sodium chloride powder (0.8 times by mole the stoichiometric amount of calcium fluoride to be formed) and 37.2 g of potassium chloride powder (0.8 times by mole the stoichiometric amount of calcium fluoride to be formed) were provided, and these starting materials were mixed in a V-type mixer to prepare 343.5 g of a mother material. This mother material was charged into a boron nitride container, and heated in an argon gas atmosphere at 1200° C. for 4 hours. After separation of the resulting alloy from the slag, the container was inclined to permit the alloy to flow into an ingot case. Thus, 161.4 g of the alloy was obtained. The analysis of the alloy composition revealed that it contained 35.7 weight % of neodymium, 1.30 weight % of boron, 0.02 weight % of calcium and balance iron. The oxygen content was 47 ppm.

This alloy was formed into a permanent magnet in the same manner as in Example 1, and its magnetic properties were measured. As a result, its residual magnetic flux density $4\pi Ir$ was 12.1 KG, coercive force iHc 10.7 KOe, and maximum energy product (BH)max 34.3 MGOe. The sample had an oxygen content of 4400 ppm and a calcium content of 0.02 weight %.

EXAMPLE 8

406 g of neodymium fluoride powder, 48.6 g of dysprosium fluoride powder, 173 g of metal calcium powder under 10 mesh (1.25 times by weight the stoichiometrically necessary amount), 578 g of iron powder under 32 mesh, 55 g of ferroboron powder under 32 mesh (20 weight % boron and balance iron), 30 g of ferroniobium powder under 32 mesh (60 weight % Nb and balance Fe), 384 g of calcium chloride powder (1.0 times by mole the stoichiometric amount of calcium fluoride to be formed) were provided, and these starting materials were mixed in a V-type mixer to prepare 1674.6 g of a mother material. This mother material was charged into an iron container, and heated in an argon gas atmosphere at 1180° C. for 4 hours. After cooling, the slag was washed away by an alcohol aqueous solution, and the resulting alloy was rinsed with alcohol and dried in vacuum. Hydrogen gas was introduced at room temperature to let the alloy absorb it. After completion of pulverization by the absorption of hydrogen, the hydrogen gas was purged by Ar gas, and the alloy was further subjected to dehydrogenation treatment at 400° C. for one hour. The analysis of the alloy composition revealed that it contained 29.7 weight % of neodymium, 3.7 weight % of dysprosium, 1.0 weight % of boron, 1.8 weight % of niobium, 0.02 weight % of calcium and balance iron. The oxygen content was 1500 ppm, and the hydrogen content was 16000 ppm.

This alloy was subjected to milling by a jet mill to provide fine powder of 3.0 μm in average particle size. Next, this fine powder was pressed under 2 tons/cm$^2$ in a magnetic field of 10 kOe, and the resulting green body was sintered in vacuum at 1090° C. for one hour. Finally, the sintered body was heat-treated at 900° C. for 2 hours, and cooled down to room temperature at 1° C./min. It was further heated at 600° C. for one hour and then rapidly quenched by immersion in water. The measurement of the resulting sample with respect to magnetic properties revealed that it had a residual magnetic flux density $4\pi Ir = 11.5KG$, a coercive force bHc = 11.0 KOe and iHc = 19.5 KOe, and a maximum energy product (BH)max = 31.7 MGOe. The sample contained 5200 ppm of oxygen and 0.02 weight % of calcium.

EXAMPLE 9

340 g of neodymium fluoride powder, 124 g of dysprosium fluoride powder, 174 g of metal calcium powder under 10 mesh (1.25 times by weight the stoichiometrically necessary amount), 573 g of iron powder under 32 mesh, 54 g of ferroboron powder under 32 mesh (20 weight % of boron and balance iron), 29 g of ferroniobium powder under 32 mesh (60 weight % Nb and balance Fe), and 241 g of calcium chloride powder (0.5 times by mole the stoichiometric amount of calcium fluoride to be formed), 104 g of potassium chloride powder (0.8 times by mole the stoichiometric amount of calcium fluoride to be formed) and 122 g of sodium chloride powder (1.2 times by mole the stoichiometric amount of calcium fluoride to be formed) were provided, and these starting materials were mixed in a V-type mixer to prepare a mother material. This mother material was charged into a stainless steel container, and heated in an argon gas atmosphere at 1200° C. for 2 hours. After separation of the resulting alloy from the slag, the container was inclined to permit the alloy to flow into an ingot case. An ingot withdrawn from the ingot case was washed with water. Thus, 988 g of the alloy was obtained. The analysis of the alloy composition revealed that it contained 24.6 weight % of neodymium, 9.2 weight % of dysprosium, 1.1 weight % of boron, 1.8 weight % of niobium, 0.03 weight % of calcium and balance iron.

This alloy was pulverized and formed into a permanent magnet in the same manner as in Example 8, and its magnetic properties were measured. As a result, its residual magnetic flux density $4\pi Ir$ was 10.9KG, coercive force bHc 10.3 KOe and iHc 25.9 KOe, and maximum energy product (BH)max 28.2 MGOe. The sample had an oxygen content of 4800 ppm and a calcium content of 0.03 weight %.

EXAMPLE 10

449 g of neodymium fluoride powder, 13 g of dysprosium fluoride powder, 224 g of calcium hydride powder (1.5 times by weight the stoichiometrically necessary amount), 569 g of iron powder under 32 mesh, 54 g of ferroboron powder under 10 mesh, 30 g of ferroniobium powder under 10 mesh (60 weight % Nb and balance Fe), 393 g of calcium chloride powder (1.0 times by mole the stoichiometric amount of calcium fluoride to be formed) were provided, and these starting materials were mixed in a V-type mixer to prepare 1732 g of a mother material. This mother material was charged into a tantalum container, and heated in an argon gas atmosphere at 1200° C. for 4 hours. After completion of the reduction reaction, the slag was washed away by an alcohol aqueous solution and the resulting alloy was pulverized by the absorption of hydrogen in the same manner as in Example 8 to provide 985 g of the coarsely pulverized alloy. The analysis of the alloy composition revealed that it contained 32.7 weight % of neodymium, 1.0 weight % of dysprosium, 1.1 weight % of boron, 1.8 weight % of niobium 0.01 weight % of calcium and balance iron. The oxygen content was 1300 ppm.

This alloy was formed into a permanent magnet in the same way as in Example 8. The measurement of the resulting alloy with respect to magnetic properties revealed that it had a residual magnetic flux density $4\pi Ir = 12.4KG$, a coercive force bHc=11.8 KOe and iHc=14.9 KOe, and a maximum energy product (BH)max=35.8 MGOe. The sample contained 3700 ppm of oxygen and 0.01 weight % of calcium.

EXAMPLE 11

418 g of neodymium fluoride powder, 54 g of dysprosium fluoride powder, 252 g of metal calcium powder under 10 mesh (1.75 times by weight the stoichiometrically necessary amount), 608 g of iron powder under 32 mesh, 12 g of boron powder under 32 mesh, 30 g of ferroniobium powder under 32 mesh (60 weight % Nb and balance Fe), and 105 g of sodium chloride powder (0.5 times by mole the stoichiometric amount of calcium fluoride to be formed) were provided, and these starting materials were mixed in a V-type mixer to prepare 1479 g of a mother material. This mother material was charged into an iron container, and heated under the same conditions as in Example 8. After separation of the resulting alloy from the slag, the container was inclined to permit the alloy to flow into an ingot case. Thus, 980 g of the alloy was obtained. The analysis of the alloy composition revealed that it contained 30.0 weight % of neodymium, 4.0 weight % of dysprosium, 1.2 weight % of boron, 1.8 weight % of niobium, 0.02 weight % of calcium and balance iron. The oxygen content was 70 ppm.

This ingot was pulverized and formed into a permanent magnet in the same manner as in Example 8, and its magnetic properties were measured. As a result, its residual magnetic flux density $4\pi Ir$ was 11.3KG, coercive force bHc 10.9 KOe and iHc 20.0 KOe, and maximum energy product (BH)max 29.6 MGOe. The sample had an oxygen content of 4700 ppm and a calcium content of 0.02 weight %.

EXAMPLE 12

This example shows the relations between the amounts and types of reducing agents and the amount of calcium contained in the resulting alloys and the magnetic properties of the permanent magnets prepared therefrom.

The same procedure as in Example 1 was conducted using as a reducing agent metal calcium and calcium hydride to provide Nd-Fe-B alloys of 36.0 weight % Nd, 1.3 weight % B and balance Fe. The amount of the reducing agent used was 0.8–3.0 times by weight as much as stoichiometrically necessary for the reduction reaction of neodymium fluoride. The results are shown in Table 1.

TABLE 1

| Alloy Comp. | Reducing Agent | Item | Amount of Reducing Agent (Times by Weight) 0.8 | 0.9 | 1.0 | 1.5 | 2.0 | 2.5 | 3.0 |
|---|---|---|---|---|---|---|---|---|---|
| Nd 36.0 wt % B 1.3 wt % Fe Balance | Metal Calcium | Calcium Content (wt %) | 0.01 | 0.02 | 0.02 | 0.02 | 0.02 | 0.03 | 0.05 |
| | | $4\pi Ir$ (KG) | 13.0 | 12.7 | 12.1 | 12.1 | 12.1 | 11.7 | 11.2 |
| | | iHc (KOe) | 5.2 | 8.0 | 11.0 | 11.0 | 11.0 | 10.0 | 8.8 |
| | Calcium Hydride | Calcium Content (wt %) | 0.01 | 0.02 | 0.02 | 0.02 | 0.02 | 0.03 | 0.05 |
| | | $4\pi Ir$ (KG) | 12.9 | 12.7 | 12.1 | 12.1 | 12.1 | 11.8 | 11.0 |
| | | iHc (KOe) | 5.4 | 7.8 | 11.0 | 11.0 | 11.0 | 10.2 | 9.0 |

As is clear from Table 1, the addition of the reducing agent 1.0 or more times by weight as much as stoichiometrically necessary for the reduction reaction can provide low calcium content in the resulting alloy as well as permanent magnets with good magnetic properties. The preferred amount of the reducing agent appears to be 1.0–2.0 times by weight the stoichiometric amount.

EXAMPLE 13

This example also shows the relations between the amounts and types of reducing agents and the amount of calcium contained in the resulting alloys and the magnetic properties of the permanent magnets prepared therefrom.

The same measurement as in Example 12 was conducted on Nd-Dy-Fe-B-Nb alloys of 29.7 weight % Nd, 3.7 weight % Dy, 1.3 weight % B, 1.8 weight % Nb and balance Fe. The results are shown in Table 2.

TABLE 2

| Alloy Comp. | Reducing Agent | Item | Amount of Reducing Agent (Times by Weight) 0.8 | 0.9 | 1.0 | 1.5 | 2.0 | 2.5 | 3.0 |
|---|---|---|---|---|---|---|---|---|---|
| | | Calcium Content (wt %) | 0.01 | 0.02 | 0.02 | 0.02 | 0.02 | 0.03 | 0.05 |
| Nd 29.7 wt % Dy 3.7 wt % B 1.3 wt % Nb 1.8 wt % Fe Balance | Metal Calcium | 4πIr (KG) | 11.8 | 11.5 | 10.9 | 10.9 | 10.9 | 10.5 | 10.1 |
| | | iHc (KOe) | 10.5 | 12.8 | 17.0 | 18.0 | 17.5 | 17.0 | 13.0 |
| | | Calcium Content (wt %) | 0.01 | 0.02 | 0.02 | 0.02 | 0.02 | 0.03 | 0.05 |
| | Calcium Hydride | 4πIr (KG) | 11.7 | 11.5 | 10.9 | 10.9 | 10.9 | 10.5 | 10.1 |
| | | iHc (KOe) | 12.5 | 13.7 | 18.0 | 18.7 | 17.5 | 17.0 | 13.1 |

EXAMPLE 14

This example shows relation between the amount of the flux (times by mole) and the separation of slag from alloy.

The same procedure as in Example 1 was conducted using various types of flux compounds in various amounts between 0.3–4.0 times by mole as much as necessary for forming calcium fluoride by the reduction reaction of neodymium fluoride, to provide Nd-Fe-B alloys of 41.0 weight % Nd, 1.2 weight % B and balance Fe. The results are shown in Table 3.

TABLE 3

| Alloy Composition | Type of Flux | Heating Temperature (°C.) | Amount of Flux (Times by Mole) 0.3 | 0.4 | 0.5 | 1.0 | 2.0 | 4.0 |
|---|---|---|---|---|---|---|---|---|
| Nd 41.0 wt % B 1.2 wt % Fe Balance | $CaCl_2$ | 1,000 | No | No | Yes | Yes | Yes | Yes |
| | | 1,200 | No | No | Yes | Yes | Yes | Yes |
| | NaCl | 1,000 | No | No | Yes | Yes | Yes | Yes |
| | | 1,200 | No | No | Yes | Yes | Yes | Yes |
| | KCl | 1,000 | No | No | Yes | Yes | Yes | Yes |
| | | 1,200 | No | No | Yes | Yes | Yes | Yes |

Note
No: Not Separated
Yes: Separated

As is clear from Table 3, the amount of flux is 0.5 times or more (by mole) to ensure the separation of slag from the resulting alloys in this system.

EXAMPLE 15

This example also shows the relations between the amount of the flux (times by mole) and the separation of slag from alloy.

The same measurement as in Example 14 was conducted on Nd-Dy-Fe-B-Nb alloys of 38.0 weight % Nd, 3.7 weight % Dy, 1.3 weight % B, 1.8 weight % Nb and balance Fe. The results are shown in Table 4.

TABLE 4

| Alloy Composition | Type of Flux | Heating Temperature (°C.) | Amount of Flux (Times by Mole) 0.02 | 0.04 | 0.05 | 1.0 | 2.0 | 4.0 |
|---|---|---|---|---|---|---|---|---|
| Nd 38.0 wt % Dy 3.7 wt % B 1.3 wt % Nb 1.8 wt % Fe Balance | $CaCl_2$ | 1,000 | No | No | Yes | Yes | Yes | Yes |
| | | 1,200 | No | No | Yes | Yes | Yes | Yes |
| | | 1,000 | No | No | Yes | Yes | Yes | Yes |
| | | 1,200 | No | No | Yes | Yes | Yes | Yes |
| | NaCl | 1,000 | No | No | Yes | Yes | Yes | Yes |
| | | 1,200 | No | No | Yes | Yes | Yes | Yes |
| | KCl | 1,000 | No | No | Yes | Yes | Yes | Yes |
| | | 1,200 | No | No | Yes | Yes | Yes | Yes |

Note
No: Not Separated
Yes: Separated

EXAMPLE 16

This example shows the relations between the heating temperature and the separation of alloys from slags.

The same procedure as in Example 1 was conducted using various types and amounts of flux compounds with various heating temperatures between 900° C. and 1350° C. to provide Nd-Fe-B alloys of 38.0 weight % Nd, 1.2 weight % B and balance Fe. The results are shown in Table 5.

TABLE 5

| Alloy Composition | Flux Type | Flux Amount (Times by Mole) | Heating Temperature (°C.) 900 | 950 | 1,000 | 1,150 | 1,300 | 1,350 |
|---|---|---|---|---|---|---|---|---|
| Nd 38.0 wt % B 1.2 wt % Fe | $CaCl_2$ | 0.5 | No | No | Yes | Yes | Yes | Yes |
| | | 2.0 | No | No | Yes | Yes | Yes | Yes |
| | NaCl | 0.5 | No | No | Yes | Yes | Yes | Yes |
| | | 2.0 | No | No | Yes | Yes | Yes | Yes |
| | | 0.5 | No | No | Yes | Yes | Yes | Yes |

TABLE 5-continued

| Alloy Composition | Flux Type | Flux Amount (Times by Mole) | Heating Temperature (°C.) 900 | 950 | 1,000 | 1,150 | 1,300 | 1,350 |
|---|---|---|---|---|---|---|---|---|
| Balance | KCl | 2.0 | No | No | Yes | Yes | Yes | Yes |

Note
No: Not Separated
Yes: Separated

As is clear from Table 5, the heating temperature of 1000° C. or higher ensures the separation of alloys from slags.

EXAMPLE 17

This example also shows the relations between the heating temperature and the separation of alloys from slags.

The same measurement as in Example 16 was conducted on Nd-Dy-Fe-B-Nb alloys of 35.5 weight % Nd, 4.6 weight % Dy, 1.0 weight % B, 1.1 weight % Nb and balance Fe. The results are shown in Table 6.

TABLE 6

| Alloy Composition | Flux Type | Flux Amount (Times by Mole) | Heating Temperature (°C.) 900 | 950 | 1,000 | 1,150 | 1,300 | 1,350 |
|---|---|---|---|---|---|---|---|---|
| Nd 35.5 wt % | $CaCl_2$ | 0.03 | No | No | Yes | Yes | Yes | Yes |
| Dy 4.6 wt % | | 4.0 | No | No | Yes | Yes | Yes | Yes |
| B 1.0 wt % | | 0.03 | No | No | Yes | Yes | Yes | Yes |
| Nb 1.1 wt % | NaCl | 4.0 | No | No | Yes | Yes | Yes | Yes |
| Fe Balance | | 0.03 | No | No | Yes | Yes | Yes | Yes |
| | KCl | 4.0 | No | No | Yes | Yes | Yes | Yes |

TABLE 6-continued

| Alloy Composition | Flux Type | Flux Amount (Times by Mole) | Heating Temperature (°C.) 900 | 950 | 1,000 | 1,150 | 1,300 | 1,350 |
|---|---|---|---|---|---|---|---|---|
| Balance | | | | | | | | |

Note
No: Not Separated
Yes: Separated

EXAMPLE 18

This example shows the relations between the heating temperature and the amount of impurities coming from a crucible.

The same procedure as in Example 1 was conducted using a stainless steel crucible with various heating temperatures between 1000° C. and 1400° C. to provide Nd-Fe-B alloys of 36.0 weight % Nd, 1.3 weight % B and balance Fe. The results are shown in Table 7.

TABLE 7

| Alloy Composition | Type of Flux | Item | Heating Temperature (°C.) 1,000 | 1,150 | 1,250 | 1,300 | 1,350 | 1,400 |
|---|---|---|---|---|---|---|---|---|
| Nd 36.0 wt % | $CaCl_2$ | Ni Content (wt %) | <0.01 | <0.01 | <0.01 | <0.01 | 0.23 | 0.61 |
| B 1.3 wt % | 1.0 Times | Cr content (wt %) | <0.01 | <0.01 | <0.01 | <0.01 | 0.12 | 0.33 |
| Fe Balance | (by mole) | $4\pi Ir$(KG) | 12.1 | 12.1 | 12.1 | 12.1 | 11.4 | 10.2 |
| | | iHc(KOe) | 11.0 | 11.0 | 11.0 | 11.0 | 9.3 | 6.8 |

As is clear from Table 7, when the heating temperature exceeds 1300° C., impurities such as Ni and Cr are transferred into the resulting alloys in unacceptably large amounts.

EXAMPLE 19

This example also shows the relations between the heating temperature and the amount of impurities coming from a crucible.

The same measurement as in Example 18 was conducted on Nd-Dy-Fe-B-Nb alloys of 29.5 weight % Nd, 6.0 weight % Dy, 1.5 weight % B, 1.3 weight % Nb and balance Fe. The results are shown in Table 8.

TABLE 8

| Alloy Composition | Type of Flux | Item | Heating Temperature (°C.) 1,000 | 1,150 | 1,250 | 1,300 | 1,350 | 1,400 |
|---|---|---|---|---|---|---|---|---|
| Nd 29.5 wt % | | Ni Content (wt %) | <0.01 | <0.01 | <0.01 | <0.01 | 0.21 | 0.58 |
| Dy 6.0 wt % | $CaCl_2$ | | | | | | | |
| B 1.5 wt % | | Cr content (wt %) | <0.01 | <0.01 | <0.01 | <0.01 | 0.13 | 0.31 |
| Nb 1.3 wt % | 1.2 Times | $4\pi Ir$(KG) | 12.3 | 12.3 | 12.3 | 12.3 | 11.5 | 10.4 |
| Fe Balance | (by mole) | iHc(KOe) | 10.8 | 10.8 | 10.8 | 10.8 | 9.0 | 6.5 |

COMPARATIVE EXAMPLE 1

43.2 g of metal neodymium, 69.0 g of pure iron, 7.8 g of ferroboron powder (20.4 weight % of boron and balance iron) were melted in an argon gas atmosphere. Thus, 118.5 g of the alloy was obtained. The analysis of the alloy composition revealed that it contained 35.8 weight % of neodymium, 1.30 weight % of boron, 0.004 weight % of calcium and balance iron. The oxygen content was 48 ppm. This alloy was formed into a permanent magnet in the same manner as in Example 1, and its magnetic properties were measured. As a result, its residual magnetic flux density $4\pi Ir$ was 12.0 KG, coercive force iHc 11.2 KOe, and maximum energy product (BH)max 34.2 MGOe. The sample had an oxygen content of 4400 ppm and a calcium content of 0.004 weight %.

COMPARATIVE EXAMPLE 2

125.9 g of neodymium oxide powder, 56.2 g of metal calcium under 10 mesh (1.25 times by weight the stoichiometrically necessary amount), 172.3 g of iron powder under 100 mesh and 19.8 g of ferroboron powder under 100 mesh (20.4 weight % of boron and balance iron) were provided, and these starting materials were mixed in a V-type mixer to prepare 374.2 g of a mother material. This mother material was charged into a stainless steel container, and heated in an argon gas atmosphere at 1200° C. for 4 hours to carry out a reduction reaction.

Next, the reaction product was charged into water, and washing was repeated to remove the formed CaO. Thus, the resulting coarse powder was 288.0 g on a dry basis. The analysis of the coarse powder composition revealed that it contained 35.4 weight % of neodymium, 1.30 weight % of boron, 0.25 weight % of calcium and balance iron. The oxygen content was 6000 ppm.

This alloy was formed into a permanent magnet by carrying out fine pulverization, pressing, sintering and heat treatment in the same manner as in Example 1, and its magnetic properties were measured. As a result, its residual magnetic flux density $4\pi Ir$ was 11.8 KG, coercive force iHc 8.5 KOe, and maximum energy product (BH)max 32.0 MGOe. The sample had an oxygen content of 9000 ppm and a calcium content of 0.25 weight %.

COMPARATIVE EXAMPLE 3

209.2 g of neodymium fluoride powder, 78.2 g of metal calcium under 10 mesh (1.25 times by weight the stoichiometrically necessary amount), 50.0 g of iron powder under 32 mesh, and 172.8 g of calcium chloride powder (1.0 times by mole the stoichiometric amount of calcium fluoride to be formed) were provided, and these starting materials were mixed in a V-type mixer to prepare 510.2 g of a mother material. This mother material was charged into a stainless steel container, and heated in an argon gas atmosphere at 900° C. for 1 hour. After separation of the resulting alloy from the slag, the container was inclined to permit the alloy to flow into an ingot case. Thus, 194.0 g of the alloy was obtained. The analysis of the alloy composition revealed that it contained 74.8 weight % of neodymium, 0.35 weight % of calcium and balance iron. The oxygen content was 75 ppm. 57.8 g of this alloy was mixed with 54.6 g of pure iron and 7.8 g of ferroboron (20.4 weight % of boron and balance iron), and the resulting mixture was arc-melted in an argon gas atmosphere. During the melting, a large amount of calcium gas was evolved, contaminating the inner walls of the furnace used. Thus, 117.8 g of an alloy was obtained. The analysis of this alloy revealed that it contained 35.7 weight % of neodymium, 1.29 weight % of boron, 0.08 weight % of calcium and balance iron. The oxygen content was 55 ppm. This alloy was formed into a permanent magnet in the same manner as in Example 1, and its magnetic properties were measured. As a result, its residual magnetic flux density $4\pi Ir$ was 11.9 KG, coercive force iHc 10.7 KOe, and maximum energy product (BH)max 33.5 MGOe. The sample had an oxygen content of 4600 ppm and a calcium content of 0.08 weight %.

COMPARATIVE EXAMPLE 4

336 g of neodymium oxide powder, 64 g of dysprosium oxide powder, 183 g of metal calcium powder under 10 mesh (1.25 times by weight the stoichiometrically necessary amount), 11 g of boron powder under 32 mesh, 29 g of ferroniobium under 32 mesh (60 weight % Nb and balance Fe) and 605 g of iron powder under 100 mesh were mixed to prepare 1228 g of a mother material. This mother material was charged into an iron container, and heated in an argon gas atmosphere at 1200° C. for 4 hours to carry out the reduction reaction.

Next, the reaction product was charged into water, and washing was repeated to remove the formed CaO. Thus, the resulting coarse powder was 930 g on a dry basis. The analysis of the coarse powder composition revealed that it contained 29.5 weight % of neodymium, 3.6 weight % of dysprosium, 1.1 weight % of boron, 1.8 weight % of niobium, 0.27 weight % of calcium and balance iron. The oxygen content was 7000 ppm.

This coarse alloy powder was formed into a permanent magnet by carrying out milling, pressing, sintering and heat treatment in the same manner as in Example 8, and its magnetic properties were measured. As a result, its residual magnetic flux density $4\pi Ir$ was 11.0KG, coercive force bHc 10.3 KOe and iHc 14.5 KOe, and maximum energy product (BH)max 28.3 MGOe. The sample had an oxygen content of 9500 ppm and a calcium content of 0.25 weight %.

As described above in detail, the method of the present invention makes it possible to provide a neodymium-iron-boron permanent magnet alloy containing extremely small amounts of calcium and oxygen and having sufficiently acceptable magnetic properties at low costs.

The present invention has been explained by the above examples, but it should be noted that it is not intended to be restricted thereto, and that any modifications can be made unless they deviate from the scope of the present invention defined by the claims attached hereto.

What is claimed is:

1. A method of producing a neodymium-iron-boron permanent magnet alloy consisting essentially of 25.0–50.0 weight % of neodymium, 0.3–5.0 weight % of boron and balance substantially iron, comprising the steps of adding metal calcium, calcium hydride or a mixture thereof as a reducing agent to neodymium fluoride, iron and boron (or ferroboron), and further adding thereto at least one of calcium chloride, sodium chloride and potassium chloride as a flux, melting the resulting mixture at a temperature in the range of about 1,000° C. to about 1,300° C. in an inert gas atmosphere, a reducing gas atmosphere, or substantially in vacuum, thereby reducing said neodymium fluoride to provide said alloy with an extremely small calcium content.

2. The method of producing a neodymium-iron-boron permanent magnet alloy according to claim 1, wherein metal calcium, calcium hydride or a mixture thereof as a reducing agent is added in an amount of 1.0–4.0 times (by weight) as much as stoichiometrically necessary for the reduction reaction of said neodymium fluoride.

3. The method of producing a neodymium-iron-boron permanent magnet alloy according to claim 1, wherein at least one of calcium chloride, sodium chloride and potassium chloride as a flux is added in an amount of 0.05–4.0 times (by mole) as much as stoichiometrically necessary for forming calcium fluoride by the reduction reaction of said neodymium fluoride.

4. The method of producing a neodymium-iron-boron permanent magnet alloy according to claim 1, wherein the calcium content in the resulting alloy is 0.1 weight % or less.

5. A method of producing a neodymium-dysprosium-iron-boron-niobium permanent magnet alloy consisting essentially of 25.0–50.0 weight % of neodymium, 0.5–15.0 weight % of dysprosium, 0.3–5.0 weight % of boron, 0.05–5.0 weight % of niobium and balance substantially iron, comprising the steps of adding metal calcium, calcium hydride or a mixture thereof as a reducing agent to neodymium fluoride, dysprosium fluoride, iron, boron (or ferroboron), and niobium (or ferroniobium), and further adding thereto at least one of calcium chloride, sodium chloride and potassium chloride as a flux, melting the resulting mixture at a temperature in the range of about 1,000° C. to about 1,300° C. in an inert gas atmosphere, a reducing gas atmosphere, or substantially in vacuum, thereby reducing said neodymium fluoride and said dysprosium fluoride to provide said alloy with an extremely small calcium content.

6. The method of producing a neodymium-dysprosium-iron-boron-niobium permanent magnet alloy according to claim 5, wherein metal calcium, calcium hydride or a mixture thereof as a reducing agent is added in an amount of 1.0–4.0 times (by weight) as much as stoichiometrically necessary for the reduction reaction of said neodymium fluoride and said dysprosium fluoride.

7. The method of producing a neodymium-dysprosium-iron-boron-niobium permanent magnet alloy according to claim 5, wherein at least one of calcium chloride, sodium chloride and potassium chloride as a flux is added in an amount of 0.05–4.0 times (by mole) as much as stoichiometrically necessary for forming calcium fluoride by the reduction reaction of said neodymium fluoride and said dysprosium fluoride.

8. The method of producing a neodymium-dysprosium-iron-boron-niobium permanent magnet alloy according to claim 5, wherein the calcium content in the resulting alloy is 0.1 weight % or less.

9. The method of producing a neodymium-iron-boron permanent magnet alloy according to claim 1, wherein the calcium content in the resulting alloy is 0.06 weight % or less.

10. The method of producing a neodymium-dysprosium-iron-boron-niobium permanent magnet alloy according to claim 5, wherein the calcium content in the resulting alloy is 0.06 weight % or less.

11. The method of producing a neodymium-iron-boron permanent magnet alloy of claim 1, wherein said step of melting the resulting mixture is at a temperature in the range of about 1,050° C. to about 1,300° C.

12. The method of producing a neodymium-dysprosium-iron-boron-niobium permanent magnet alloy according to claim 5, wherein said step of melting the resulting mixture is at a temperature in the range of about 1,050° C. to about 1,300° C.

* * * * *